US007472830B2

(12) United States Patent
Danielson

(10) Patent No.: US 7,472,830 B2
(45) Date of Patent: Jan. 6, 2009

(54) COMPACT LASER AIMING ASSEMBLY FOR A FIREARM

(75) Inventor: Lewis Danielson, Portland, OR (US)

(73) Assignee: Crimson Trace Corporation, Wilsonville, OR (US)

( * ) Notice: Subject to any disclaimer, the term of this patent is extended or adjusted under 35 U.S.C. 154(b) by 387 days.

(21) Appl. No.: 11/043,565

(22) Filed: Jan. 25, 2005

(65) Prior Publication Data

US 2006/0163359 A1 Jul. 27, 2006

(51) Int. Cl.
*G06F 19/00* (2006.01)

(52) U.S. Cl. ..... 235/404; 235/41.17; 235/41.19; 42/103

(58) Field of Classification Search ..... 235/404; 89/41.17, 41.19; 42/103
See application file for complete search history.

(56) References Cited

U.S. PATENT DOCUMENTS 5,253,443 A 10/1993 Baikrich
5,323,555 A 6/1994 Jehn
5,359,779 A 11/1994 Polk et al.
5,425,299 A 6/1995 Teetzel
5,581,898 A 12/1996 Thummel
5,586,887 A * 12/1996 McNelis et al. ..... 434/20
5,590,486 A 1/1997 Moore
5,784,823 A 7/1998 Chen

* cited by examiner

*Primary Examiner*—Karl D. Frech
(74) *Attorney, Agent, or Firm*—Davis Wright Tremaine, LLP; William A. Birdwell

(57) ABSTRACT

A compact laser aiming assembly for a firearm. A laser module having a front and a back is adapted to be rotatably seated in a socket having a window therein. The front of the module has a bearing with a convex, curved front surface and a window therein, and the laser module is adapted to support a laser in back of the bearing so that when the front of the bearing is seated in the socket, a beam of light emitted from the laser propagates through the window in the front of the laser module and through the window in the socket. A socket, having a front and a back and a window therein, is also provided. The back has a concave surface formed therein, the bearing of the laser module being seated in the socket, and the socket further has an adjustment mechanism coupled to the socket and the laser module for rotating the laser module in the socket so as to aim the beam of light. A laser is mounted in the laser module for producing a beam of light, and an electronic drive circuit is mounted in the laser module to provide electrical power to the laser diode so as to cause it to lase.

34 Claims, 2 Drawing Sheets

COMPACT LASER AIMING ASSEMBLY FOR A FIREARM

BACKGROUND OF THE INVENTION

This invention relates to laser aiming devices for firearms, and particularly to compact laser aiming assemblies providing adjustments for elevation and windage.

Laser sighting devices for firearms have been in use for some time. Basically, a laser, which emits a relatively powerful, narrow beam of light that expands minimally over a long distance, is mounted on a firearm, such as a hand gun or rifle, so as to illuminate the target with a spot of light where the bullet will strike the target. While the laser beam will, for all practical purposes, follow a straight line, the bullet will follow a ballistic trajectory so that, despite high muzzle velocity, at long distances the trajectory of the bullet will deviate significantly from a straight line. Also, the laser must necessarily be mounted to the side of the barrel of the firearm, which means that the laser beam cannot propagate in the same plane as the trajectory of the bullet. Consequently, it is necessary to aim the laser beam so that, for a given distance, the beam will illuminate the target with a spot at the position where the bullet will be after traveling that distance. The vertical angular setting of the laser beam is known as "elevation" and the lateral angular adjustment of the beam is known as "windage."

Various laser sighting devices are known that provide not only for setting the elevation and windage of the sighting laser beam, but also for convenient adjustment of those settings in the field. For example, Chen, U.S. Pat. No. 5,784,823, discloses a laser centrally mounted in a semi-spherical fixture which is disposed in a casing. The laser is positioned in the casing by rotation of the fixture therein, and held at the desired angle by frictional force. Thummel, U.S. Pat. No. 5,581,898, discloses a laser module disposed within a housing adapted to be mounted on a firearm, wherein the back of the laser module is seated in the back of the housing and orthogonal set screws are positioned to move the front of the module up and down, and back and forth, to set the elevation and windage, respectively. Jehn, U.S. Pat. No. 5,323,555, discloses a similar mechanism. Baikrich, U.S. Pat. No. 5,253,443, also discloses a laser sighting device having a laser module disposed in a housing and seated against the back of the housing, but the front of the module is moved laterally by longitudinally moving cam members having threads which engage axially rotatable rings disposed around the housing.

Devices such as these suffer from at least two limitations. One limitation is that the laser is typically disposed so far into the housing that its exit window is difficult to clean. Another limitation is that since the front of the laser module must move laterally, a large exit window is required for the housing, which places a limit on how small the housing can be. In general, these devices are fairly large, and are therefore limited in how and where they can be mounted on a firearm.

Accordingly, it has been found desirable to provide a laser sighting device that is easier to clean, and to provide a more compact laser aiming assembly so that a sighting device can be mounted at the most convenient location on a firearm.

SUMMARY OF THE INVENTION

The present invention provides a laser aiming assembly, comprising a laser module having a front and a back and adapted to be rotatably seated in a socket having a window therein, the front of the module having a bearing with a convex, curved front surface and a window therein, the laser module also being adapted to support a laser in back of the bearing so that when the front of the bearing is seated in the socket, a beam of light emitted from the laser propagates through the window in the front of the laser module and through the window in the socket. The invention may further include a socket, having a front and a back and a window therein, the back having a concave surface formed therein, the bearing of the laser module being seated in the socket, the socket further having an adjustment mechanism coupled to the socket and the laser module for rotating the laser module in the socket so as to aim the beam of light. The invention may also include a laser mounted in the laser module for producing a beam of light and an electronic drive circuit for providing electrical power to the laser diode so as to cause it to lase.

The objects, features and advantages of the invention will be more fully understood upon consideration of the following detailed description of the invention taken in conjunction with the accompanying drawings.

DETAILED DESCRIPTION OF THE INVENTION

Figure 1:
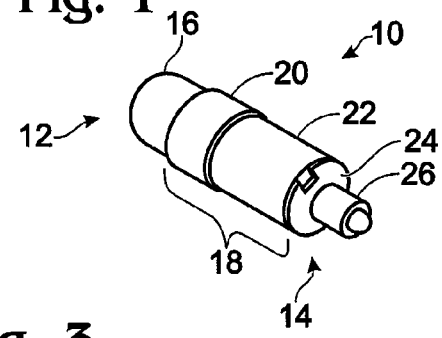
FIG. 1 is a perspective of a preferred embodiment of a laser module according to the present invention.

A preferred embodiment of a laser module 10 according to the present invention is shown in FIG. 1. The module has a front 12 and a back 14. A bearing 16, having a curved surface, preferably substantially spherical in shape, is disposed at the front of the module, and a casing 18 is mounted in back of the bearing, the casing having a laser holding portion 20 and a circuit holding portion 22. The module also includes back plug 24, having an alignment post 26, disposed at the back of the casing.

Figure 2:
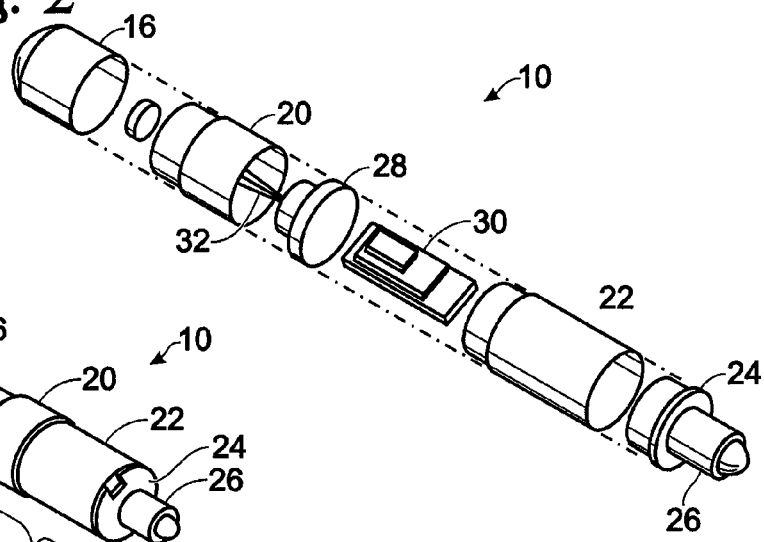
FIG. 2 is an exploded, perspective of the laser module of FIG. 1.

Turning now to FIG. 2, as well as to FIG. 1, the laser holding portion 20 holds a laser 28 disposed therein. The circuit holding portion 22 holds a laser drive circuit 30 disposed therein. The drive circuit has input connections for receiving electrical power and output connections for supplying appropriate power to the laser, as is commonly understood in the art. When electrical power is provided to the laser drive circuit 30, the laser is caused to lase and produce a light beam 32 out the front thereof.

Figure 3:
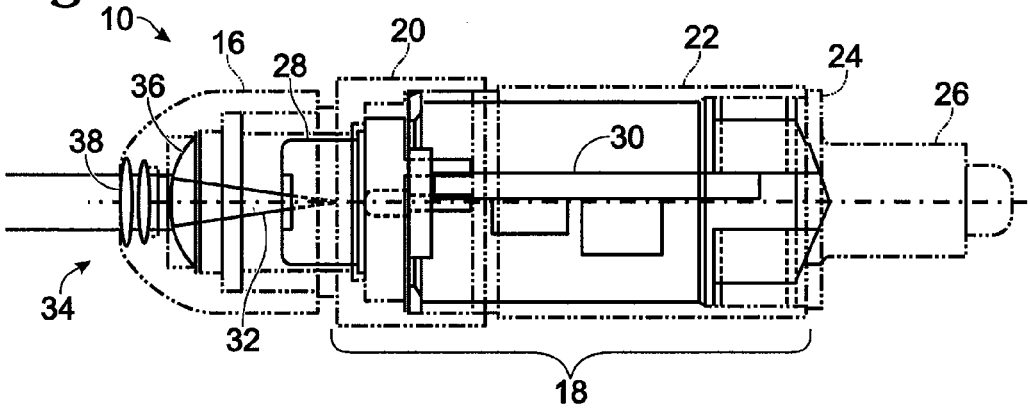
FIG. 3 is side cross section of the laser module of FIG. 1.

A side cross section of the laser module 10 is shown in FIG. 3. In this figure it can be seen that the bearing 16 has a window 34 therein, although a bearing with only an uncovered opening to allow passage of the laser light may be used without departing from the principles of the invention. Thus, window is understood to mean an opening through which light may pass, the opening being provided with a transparent covering or not. A lens 36 is mounted behind the window. Preferably, the laser 28 is a light emitting diode, that is, a diode laser, so as to minimize power consumption. Ordinarily, the output beam of a laser of this type diverges sharply, so the lens 36 preferably is a collimating lens which converts the diverging beam from the laser into a collimated beam. However, it is to be recognized that various optics may be used to produce a spot of light at the target without departing from the principles of the invention.

Figure 4:
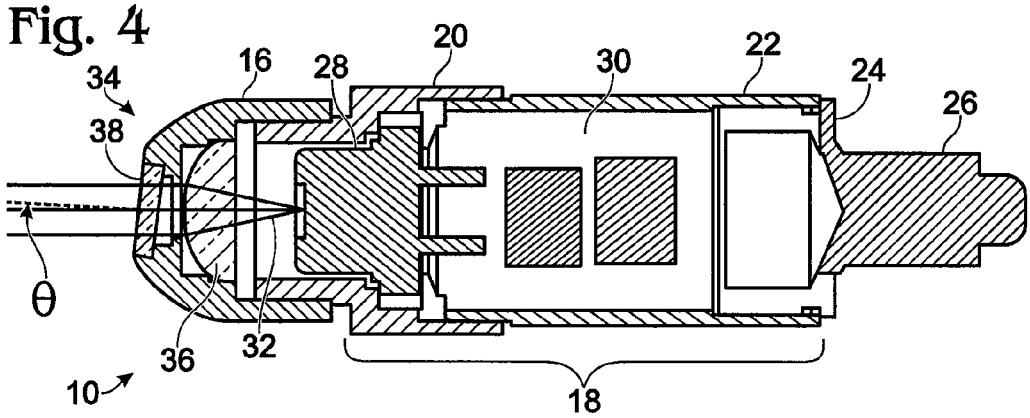
FIG. 4 is a top cross section of the laser module of FIG. 1

A top cross section of the laser module is shown in FIG. 4. In this figure it can be seen that a protective plane parallel plate 38 is preferably disposed in the window 34. The plate is set at angle θ to the axis of the beam so that light reflected off the interior surface the plate does not propagate back into the laser, and does not reflect off the laser to produce a secondary beam. The plate also serves to protect the lens 36 from scratching and dust.

Figure 5:
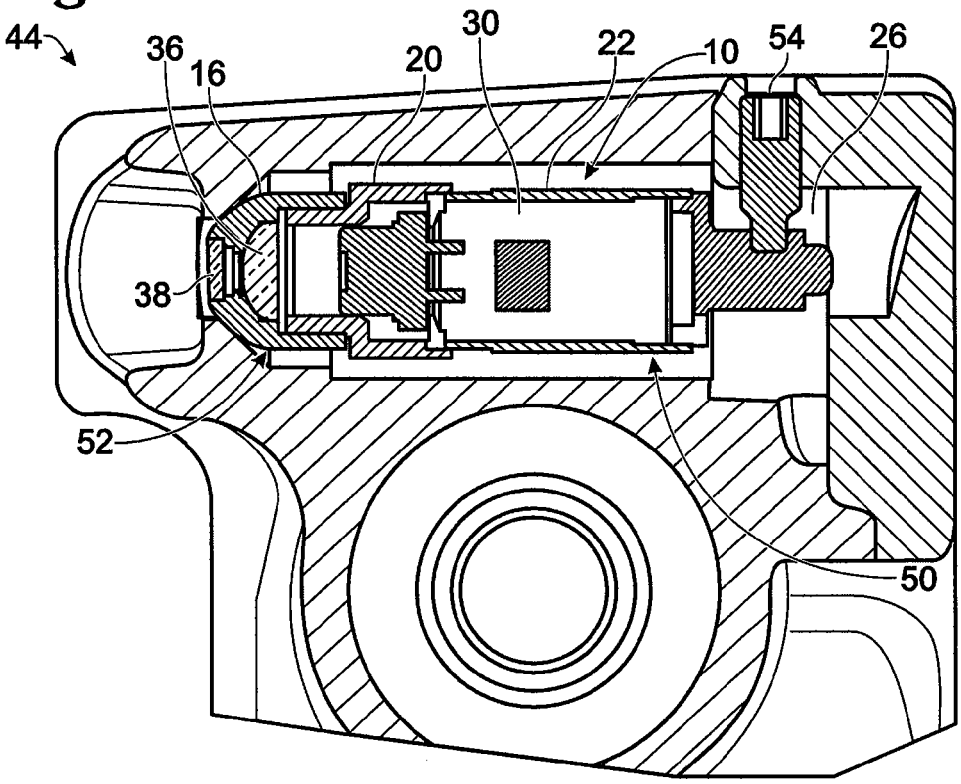
FIG. 5 is a side cross section of the laser module of FIG. 1 incorporated into a laser sighting apparatus for a firearm.
Figure 6:
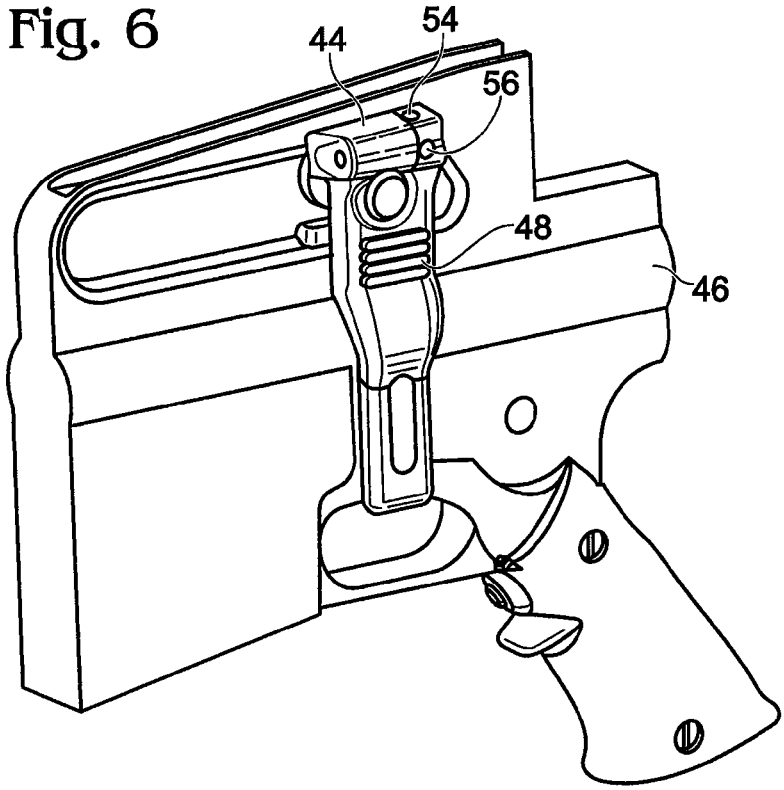
FIG. 6 is a perspective, cut away view of a firearm having the laser sighting apparatus of FIG. 5 mounted thereon.

Turning to FIGS. 5 and 6, the laser module is shown disposed in a representative housing 44 mounted to a rifle 46, shown in part, by a mounting assembly 48. Although this housing is adapted to be mounted on a particular type of firearm, as shown in FIG. 6, it is not intended to limit the scope of the invention. Other housings having some or all of the same features described hereafter may by employed with the laser module without departing from the principles of the invention.

A housing for the module, such as the representative housing 44, preferably has a protective chamber 50 formed therein with a socket 52 at the front. Preferably the socket is chamfered so as to minimize the contact between the spherical-shaped surface of the bearing 16 and the socket, thereby minimizing the possibility of binding as the module is rotated in the socket for adjusting the beam direction. The socket is concave in that it comprises a depression or recess in a surrounding surface that the bearing 16 fits within; the concavity need not, however, be hemispherical but may be of frusto-conical or other form without departing from the principles of the invention.

An elevation adjustment screw 54 and a windage adjustment screw 56 are rotatably mounted in the housing 44 at the back thereof. These screws movably engage the back post 26 of the module at right angles so as to rotate the module in the socket up and down, in the case of elevation, and side to side, in the case of the windage adjustment, as the screws are rotated so as to move in and out. Thus, these screws are used to adjust the sighting device for accurate aiming of the firearm.

The terms and expressions that have been employed in the foregoing specification are used therein as terms of description and not of limitation, and there is no intention, in the use of such terms and expressions, to exclude equivalents of the features shown and described or portions thereof, it being recognized that the scope of the invention is defined and limited only by the claims that follow

I claim:

1. A laser aiming assembly, comprising a laser module having a front end and a back end, the front end of the module forming a bearing having a convex, curved front surface and a window therein, so as to be rotatably seated in a socket having a window therein such that said window in the module is thereby located behind said window in the socket, the laser module also being adapted to support a laser in back of the bearing so that when the front of the bearing is seated in the socket, a beam of light emitted from the laser propagates first through the window in the front of the laser module and second through the window in the socket.

2. The assembly of claim 1, wherein the laser module further comprises a laser mounted therein for producing a beam of light.

3. The assembly of claim 2, wherein the laser comprises a diode laser.

4. The assembly of claim 3, wherein the laser module further comprises an electronic drive circuit for providing electrical power to the laser diode so as to cause it to lase.

5. The assembly of claim 2, wherein the laser module further comprises a drive circuit for providing electrical power to the laser so as to cause it to lase.

6. The assembly of claim 5, wherein the laser module further comprises a tubular casing disposed behind the bearing, the laser and the drive circuit being disposed within the casing.

7. The assembly of claim 6, wherein the casing comprises a laser holding part and a circuit holding part, the circuit holding part having a narrowed front that fits within a back of the laser holding part.

8. The assembly of claim 6, further comprising a back post disposed at the back of the casing for rotating the laser module.

9. The assembly of claim 6, further comprising a lens disposed in the window in the front end of the laser module.

10. The laser aiming assembly of claim 1, further comprising a socket, having a front and a back and a window therein, the back having a concave surface formed therein, the bearing of the laser module being seated in the socket, the socket further having an adjustment mechanism coupled to the socket and the laser module for rotating the laser module in the socket so as to aim the beam of light.

11. The assembly of claim 10, further comprising a back post disposed at the back of the module, the back post engaging the adjustment mechanism for rotating the laser module.

12. The assembly of claim 11, wherein the socket is part of a mounting assembly and the adjustment mechanism comprises at least one adjustment screw disposed in the mounting assembly so as to laterally engage the back post.

13. The assembly of claim 10, further comprising a transparent element disposed in the window in the socket.

14. The assembly of claim 13, wherein the laser module has an elongate axis of symmetry, the laser has an optical axis substantially parallel to the axis of symmetry and the transparent element comprises a prism for deflecting the beam of light askew to the optical axis.

15. The assembly of claim 14, wherein the socket is part of a mounting assembly and the adjustment mechanism comprises at least one adjustment screw disposed in the mounting assembly so as to laterally engage the back post.

16. The assembly of claim 10, wherein the laser module is hermetically sealed.

17. The assembly of claim 10, wherein the laser module further comprises a laser mounted therein for producing a beam of light.

18. The assembly of claim 17, wherein the laser comprises a diode laser.

19. The assembly of claim 18, wherein the laser module further comprises an electronic drive circuit for providing electrical power to the laser diode so as to cause it to lase.

20. The assembly of claim 17, wherein the laser module further comprises a drive circuit for providing electrical power to the laser so as to cause it to lase.

21. The assembly of claim 20, wherein the laser module further comprises a tubular casing disposed at the back of the module, the laser and the drive circuit being disposed within the casing.

22. The assembly of claim 21, wherein the casing comprises a laser holding part and a circuit holding part, the circuit holding part having a narrowed front that fits within a back of the laser holding part.

23. The assembly of claim 21, further comprising a back post disposed at the back of the casing for rotating the laser module.

24. The assembly of claim 21, further comprising a lens disposed in the window in the front end of the laser module.

25. The assembly of claim 1, wherein the laser module is hermetically sealed.

26. A laser aiming assembly comprising a laser module having a front and a back and adapted to be rotatably seated in a socket having a window therein, the front of the module having a bearing with a convex, curved front surface and a window therein, said laser module further comprising a tubular casing disposed at the back of the module, said tubular casing including a laser for producing a beam of light and a drive circuit for providing electrical power to the laser so as to cause it to lase, wherein said tubular casing comprises a laser holding part and a circuit holding part, the circuit holding part having a narrowed front that fits within a back of the laser holding part, the laser module also being adapted to support said laser in back of the bearing so that when the front of the bearing is seated in the socket, a beam of light emitted from said laser propagates through the window in the front of the laser module and through the window in the socket.

27. A laser aiming assembly, comprising a laser module having a front and a back and adapted to be rotatably seated in a socket having a window therein, the front of the module having a bearing with a convex, curved front surface and a window therein, said laser module further comprising a tubular casing disposed at the back of the module and a back post disposed at the back of said tubular casing for rotating the laser module, said tubular casing including a laser for producing a beam of light and a drive circuit for providing electrical power to the laser so as to cause it to lase, the laser module also being adapted to support said laser in back of the bearing so that when the front of the bearing is seated in the socket, a beam of light emitted from said laser propagates through the window in the front of the laser module and through the window in the socket.

28. A laser aiming assembly, comprising:

a laser module having a front and a back and adapted to be rotatably seated in a socket, the front of the module having a bearing with a convex, curved front surface and a window therein, said module further comprising a back post disposed at the back of the module; and a socket, having a front and a back and a window therein, the back having a concave surface formed therein, the bearing of the laser module being seated in the socket, the socket further having an adjustment mechanism coupled to the socket and the back post of the laser module for rotating the laser module in the socket so as to aim the beam of light, said laser module also being adapted to support a laser in back of the bearing so that when the front of the bearing is seated in the socket, a beam of light emitted from the laser propagates through the window in the front of the laser module and through the window in the socket.

29. The assembly of claim 28, wherein the socket is part of a mounting assembly and the adjustment mechanism comprises at least one adjustment screw disposed in the mounting assembly so as to laterally engage the back post.

30. A laser aiming assembly, comprising:

a laser module having a front and a back and adapted to be rotatably seated in a socket having a window therein, the front of the module having a bearing with a convex, curved front surface and a window therein;

a socket, having a front and a back and a window therein, the back having a concave surface formed therein, the bearing of the laser module being seated in the socket, the socket further having an adjustment mechanism coupled to the socket and the laser module for rotating the laser module in the socket so as to aim the beam of light; and a transparent element disposed in the window in the socket, said laser module also being adapted to support a laser in back of the bearing so that when the front of the bearing is seated in the socket, a beam of light emitted from the laser propagates through the window in the front of the laser module and through the window in the socket.

31. The assembly of claim 30, wherein the laser module has an elongate axis of symmetry, the laser has an optical axis substantially parallel to the axis of symmetry and the transparent element comprises a prism for deflecting the beam of light askew to the optical axis.

32. The assembly of claim 31, wherein the socket is part of a mounting assembly and the adjustment mechanism comprises at least one adjustment screw disposed in the mounting assembly so as to laterally engage the back post.

33. A laser aiming assembly, comprising:

a laser module having a front and a back and adapted to be rotatably seated in a socket having a window therein, the front of the module having a bearing with a convex, curved front surface and a window therein, said laser module further comprising a tubular casing disposed at the back of the module, said tubular casing including a laser for producing a beam of light and a drive circuit for providing electrical power to the laser so as to cause it to lase mounted therein, wherein said tubular casing comprises a laser holding part and a circuit holding part, the circuit holding part having a narrowed front that fits within a back of the laser holding part, and a socket, having a front and a back and a window therein, the back having a concave surface formed therein, the bearing of the laser module being seated in the socket, the socket further having an adjustment mechanism coupled to the socket and the laser module for rotating the laser module in the socket so as to aim the beam of light, said laser module also being adapted to support a laser in back of the bearing so that when the front of the bearing is seated in the socket, a beam of light emitted from the laser propagates through the window in the front of the laser module and through the window in the socket.

34. A laser aiming assembly, comprising:

a laser module having a front and a back and adapted to be rotatably seated in a socket having a window therein, the front of the module having a bearing with a convex, curved front surface and a window therein, said laser module further comprising a tubular casing disposed at the back of the module, said tubular casing including a laser for producing a beam of light and a drive circuit for providing electrical power to the laser so as to cause it to lase mounted therein;

a socket, having a front and a back and a window therein, the back having a concave surface formed therein, the bearing of the laser module being seated in the socket, the socket further having an adjustment mechanism coupled to the socket and the laser module for rotating the laser module in the socket so as to aim the beam of light; and a back post disposed at the back of the casing for rotating the laser module, said laser module also being adapted to support a laser in back of the bearing so that when the front of the bearing is seated in the socket, a beam of light emitted from the laser propagates though the window in the front of the laser module and though the window in the socket.

* * * * *

US007472830C1

(12) INTER PARTES REEXAMINATION CERTIFICATE (0249th)

United States Patent

Danielson

(10) Number: US 7,472,830 C1

(45) Certificate Issued: Mar. 15, 2011

(54) COMPACT LASER AIMING ASSEMBLY FOR A FIREARM

(75) Inventor: Lewis Danielson, Portland, OR (US)

(73) Assignee: Crimson Trace Corporation

Reexamination Request:
No. 95/001,289, Jan. 12, 2010

Reexamination Certificate for:

| | |
|---|---|
| Patent No.: | **7,472,830** |
| Issued: | **Jan. 6, 2009** |
| Appl. No.: | **11/043,565** |
| Filed: | **Jan. 25, 2005** |

(51) Int. Cl.
*G06F 19/00* (2006.01)

(52) U.S. Cl. ..... 235/404; 42/1.03; 89/41.17; 89/41.19

(58) Field of Classification Search ..... 235/404
See application file for complete search history.

(56) References Cited

U.S. PATENT DOCUMENTS

| | | | |
|---|---|---|---|
| 4,934,086 | A | 6/1990 | Houde-Walter |
| 5,299,375 | A | 4/1994 | Thummel et al. |
| 5,351,429 | A | 10/1994 | Ford |
| 5,509,226 | A | 4/1996 | Houde-Walter |
| 5,531,040 | A | 7/1996 | Moore |
| 6,178,649 | B1 | 1/2001 | Wu |
| 7,472,830 | B2 | 1/2009 | Danielson |

*Primary Examiner*—Christopher E Lee

(57) ABSTRACT

A compact laser aiming assembly for a firearm. A laser module having a front and a back is adapted to be rotatably seated in a socket having a window therein. The front of the module has a bearing with a convex, curved front surface and a window therein, and the laser module is adapted to support a laser in back of the bearing so that when the front of the bearing is seated in the socket, a beam of light emitted from the laser propagates through the window in the front of the laser module and through the window in the socket. A socket, having a front and a back and a window therein, is also provided. The back has a concave surface formed therein, the bearing of the laser module being seated in the socket, and the socket further has an adjustment mechanism coupled to the socket and the laser module for rotating the laser module in the socket so as to aim the beam of light. A laser is mounted in the laser module for producing a beam of light, and an electronic drive circuit is mounted in the laser module to provide electrical power to the laser diode so as to cause it to lase.

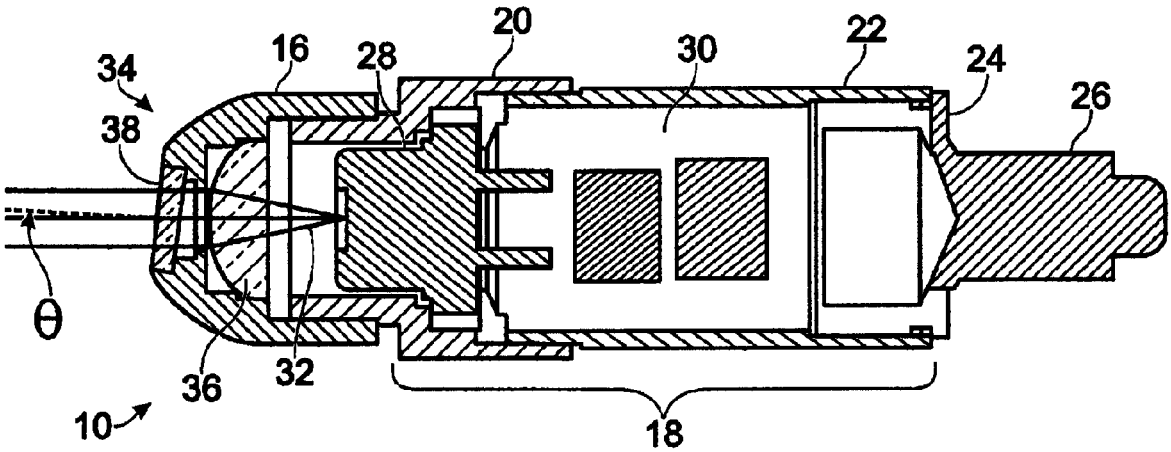

INTER PARTES REEXAMINATION CERTIFICATE ISSUED UNDER 35 U.S.C. 316

NO AMENDMENTS HAVE BEEN MADE TO THE PATENT

AS A RESULT OF REEXAMINATION, IT HAS BEEN DETERMINED THAT:

The patentability of claims 14, 15, 31 and 32 is confirmed. Claims 1-13, 16-30, 33 and 34 are cancelled.

* * * * *